US012774147B2

(12) United States Patent
Mkrtchyan

(10) Patent No.: US 12,774,147 B2
(45) Date of Patent: Oct. 27, 2026

(54) MODULAR BEVERAGE CONTAINER ASSEMBLY

(71) Applicant: Harutyun Mkrtchyan, Las Vegas, NV (US)

(72) Inventor: Harutyun Mkrtchyan, Las Vegas, NV (US)

( * ) Notice: Subject to any disclaimer, the term of this patent is extended or adjusted under 35 U.S.C. 154(b) by 181 days.

(21) Appl. No.: 18/924,981

(22) Filed: Oct. 23, 2024

(65) Prior Publication Data

US 2025/0128870 A1 Apr. 24, 2025

Related U.S. Application Data

(63) Continuation-in-part of application No. 29/915,404, filed on Oct. 30, 2023, now Pat. No. Des. 1,095,154.
(Continued)

(51) Int. Cl.
*B65D 81/32* (2006.01)
*A47G 19/22* (2006.01)
(Continued)

(52) U.S. Cl.
CPC ..... *B65D 81/3211* (2013.01); *A47G 19/2266* (2013.01); *B65D 21/083* (2013.01);
(Continued)

(58) Field of Classification Search
CPC . A47F 1/03; A47G 19/2266; A47G 2019/122; G07F 9/10; G07F 11/24;
(Continued)

(56) References Cited

U.S. PATENT DOCUMENTS 5,890,627 A 4/1999 Storey
8,777,044 B1 * 7/2014 Raymus ..... B65D 81/3205 222/129

(Continued)

FOREIGN PATENT DOCUMENTS

RU 2596450 C2 9/2016

OTHER PUBLICATIONS

Royaltoy Store, 3 Grid Portable Milk Powder Formula Dispenser BPA Free Food Container Infant Bean Storage Box for Kid Care Toddler Travel Bottle, retrieved from Internet, Retrieved on Oct. 30, 2023, <URL: https://www.aliexpress.us/item/2251832834898785.html?gatewayAdapt=glo2usa>.

(Continued)

*Primary Examiner* — Jennifer C Chiang

(57) ABSTRACT

A modular beverage container assembly is an apparatus designed to store beverage ingredients separate from each other in the same structure. The apparatus includes a drinking lid, a solvent receptacle, a dispensing cap, a solute container, a lid-interlocking snap feature, a receptacle-interlocking snap feature, a cap-interlocking snap feature, and a container-interlocking snap feature. The drinking lid enables the consumption of the desired beverage. The solvent receptacle retains the liquid base for the desired beverage. The dispensing cap enables the dispensing of the desired beverage ingredients from the solute container into the solvent receptacle. The solute container stores the beverage ingredients that can be mixed with the liquid base. The lid-interlocking snap feature and the receptacle-interlocking snap feature enable the removable attachment of the drinking lid to the solvent receptacle. The cap-interlocking snap feature and the container-interlocking snap feature enable the removable attachment of the dispensing cap to the solute container.

19 Claims, 16 Drawing Sheets

Related U.S. Application Data

(60) Provisional application No. 63/592,460, filed on Oct. 23, 2023.

(51) Int. Cl.

| | |
|---|---|
| ***B65D 21/08*** | (2006.01) |
| ***B65D 25/04*** | (2006.01) |
| ***B65D 43/02*** | (2006.01) |
| ***B65D 47/06*** | (2006.01) |

(52) U.S. Cl.
CPC ..... *B65D 25/04* (2013.01); *B65D 43/021* (2013.01); *B65D 47/06* (2013.01); *B65D 2217/04* (2013.01); *B65D 2543/00046* (2013.01); *B65D 2543/00092* (2013.01); *B65D 2543/0049* (2013.01); *B65D 2543/00629* (2013.01); *B65D 2543/00703* (2013.01); *B65D 2543/00759* (2013.01); *B65D 2543/00814* (2013.01)

(58) Field of Classification Search
CPC .. B65D 81/3211; B65D 21/083; B65D 25/04; B65D 43/021; B65D 47/06
See application file for complete search history.

(56) References Cited

U.S. PATENT DOCUMENTS

| | | | | |
|---|---|---|---|---|
| 12,214,952 | B2 * | 2/2025 | Naweed | B65D 81/3211 |
| 2006/0156811 | A1 | 7/2006 | Borowski et al. | |
| 2006/0226035 | A1 * | 10/2006 | Smith | B65D 25/08 206/219 |
| 2009/0178940 | A1 * | 7/2009 | Said | A61J 9/00 215/11.1 |

OTHER PUBLICATIONS

Milk Powder Container, 3 layer Frog Portable Baby Food Storage Box Essential Cereal Cartoon Milk Powder Boxes Toddle Kids Formula Baby Milk Container, retrieved from Internet, Retrieved on Oct. 30, 2023, <URL: https://www.alibaba.com/product-detail/3-layer-Frog-Portable-Baby-Food_1600444083622.html>.

MHW-3Bomber Official Store, MHW-3Bomber Coffee & Food Manual Vacuum Storage Canister Airtight Container Portable Camping Tool Delicate Kitchen Accessories, retrieved from Internet, Retrieved on Oct. 30, 2023, <URL: https://www.aliexpress.us/item/3256804510542200.html?gatewayAdapt=glo2usa4itemAdapt>.

Chin-Tai Pharmaceutical Plastic Ltd., AOH-100 Straight Intact Flip Bottle, retrieved from Internet, Retrieved on Oct. 30, 2023, <URL: https://www.chin-tai.com.tw/webls-en-us/product-AOH-100-%E7%9B%B4%E7%AD%92%E5%8E%9F%E5%B0%81%E6%8E%80%E8%93%8B%E7%93%B6-AOH-100.html>.

* cited by examiner

MODULAR BEVERAGE CONTAINER ASSEMBLY

The current application claims a priority to the U.S. provisional patent application Ser. No. 63/592,460 filed on Oct. 23, 2023.

The current application is also a continuation-in-part (CIP) application of the U.S. design application Ser. No. 29/915,404 filed on Oct. 30, 2023.

FIELD OF THE INVENTION

The present invention relates generally to kitchenware and modular devices. More specifically, the present invention discloses a beverage container with a modular structure that enables the selective and measured dispensing of mixed beverages using the same modular device.

BACKGROUND OF THE INVENTION

Nowadays, beverage containers are popular accessories that enable users to carry a beverage for consumption on the go. Beverage containers have been made available in various shapes, sizes, and with different storage features to accommodate different beverages and other food products. For example, thermal beverage containers have been made available to keep the beverages hot or cold for long periods. Further, newer beverage containers have been made available that help the user keep different beverages or beverage ingredients separate from each other inside the same modular structure. This feature can be very useful in many situations, such as when parents want to carry several portions of baby formula for their children. However, the currently available beverage containers do not provide appropriate means to keep the different beverages separate from each other while enabling the consumption of the desired beverage. Thus, there is a need for a modular beverage container that keeps different beverages or beverage ingredients separate from each other in the same container while still enabling the user to choose which beverage to consume.

Therefore, an objective of the present invention is to provide a modular beverage container assembly that enables users to carry different beverages or beverage containers in a single modular structure. The present invention eliminates the need to carry several containers to keep beverages or beverage ingredients separate by providing a modular structure that accommodates all the beverages and/or beverage ingredients in a single assembly. Another objective of the present invention is to provide a modular beverage container assembly that enables users to select which stored beverage and/or beverage ingredient to consume. The present invention enables the quick consumption of any beverage and/or beverage ingredient stored in the modular structure without risk of the products mixing with each other. Another objective of the present invention is to provide a modular beverage container that enables the mixing of the selected beverages and/or beverage ingredients stored in the modular structure. Additional features and benefits of the present invention are further discussed in the sections below.

SUMMARY OF THE INVENTION

The present invention discloses a modular beverage container assembly. The present invention is designed to enable the user to carry different beverages and/or beverage products separate from each other in a single modular assembly.

The present invention also enables the user to selectively consume any of the beverage and/or beverage products stored in the modular structure. In addition, the present invention enables the user to mix the beverages and/or beverage ingredients without the need for external tools or devices. For example, the present invention can be used by parents or caregivers to carry several portions of baby formula and the necessary liquid to prepare the baby formula. The present invention also enables the mixing of the liquid with the desired amount of baby formula to feed the baby.

Further, the present invention enables the quick connection of the different modules so that the users can quickly uncouple one module from the other for mixing of the beverages and/or beverage ingredients, and then recouple the modules for ease of transportation. The different modules can also be designed with an insulating structure that keeps the stored beverages and/or beverage ingredients at a desired temperature for a long period. Additional container features can be implemented to improve the overall functionality of the present invention.

DETAILED DESCRIPTION OF THE INVENTION

All illustrations of the drawings are for the purpose of describing selected versions of the present invention and are not intended to limit the scope of the present invention.

Figure 1:
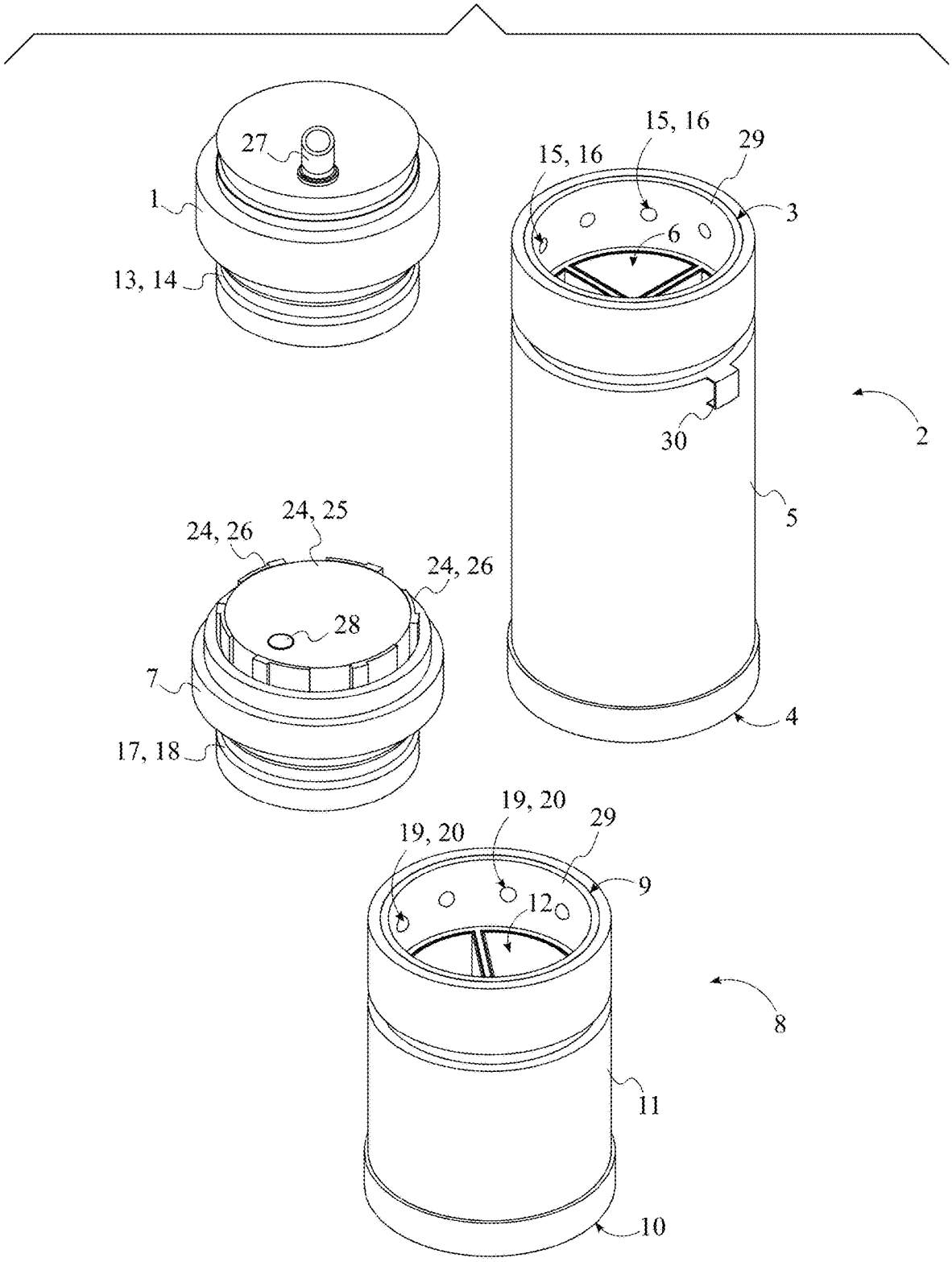
FIG. 1 is a top-front-left exploded perspective view of the present invention.
Figure 2:
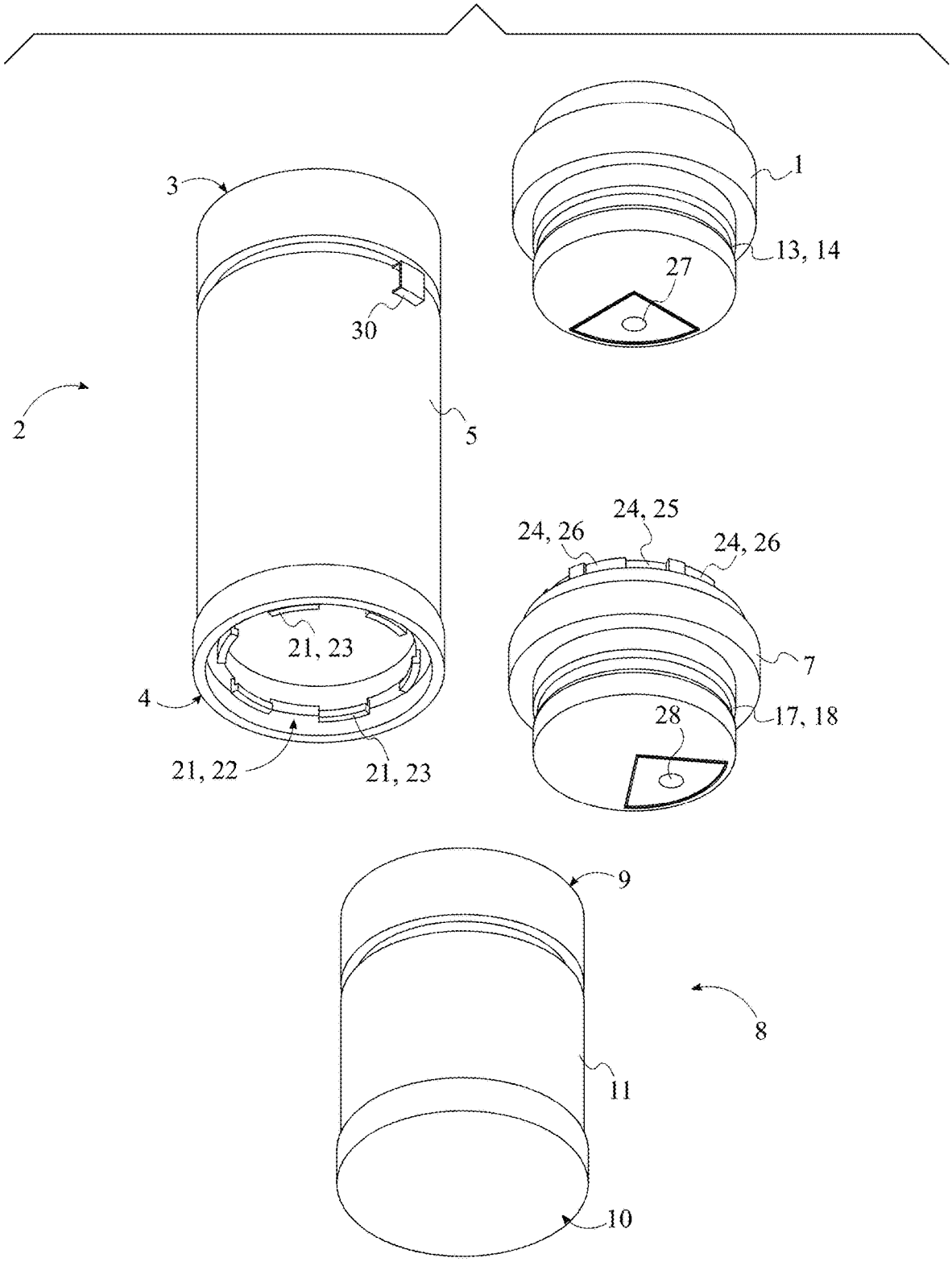
FIG. 2 is a bottom-rear-right exploded perspective view of the present invention.
Figure 3:
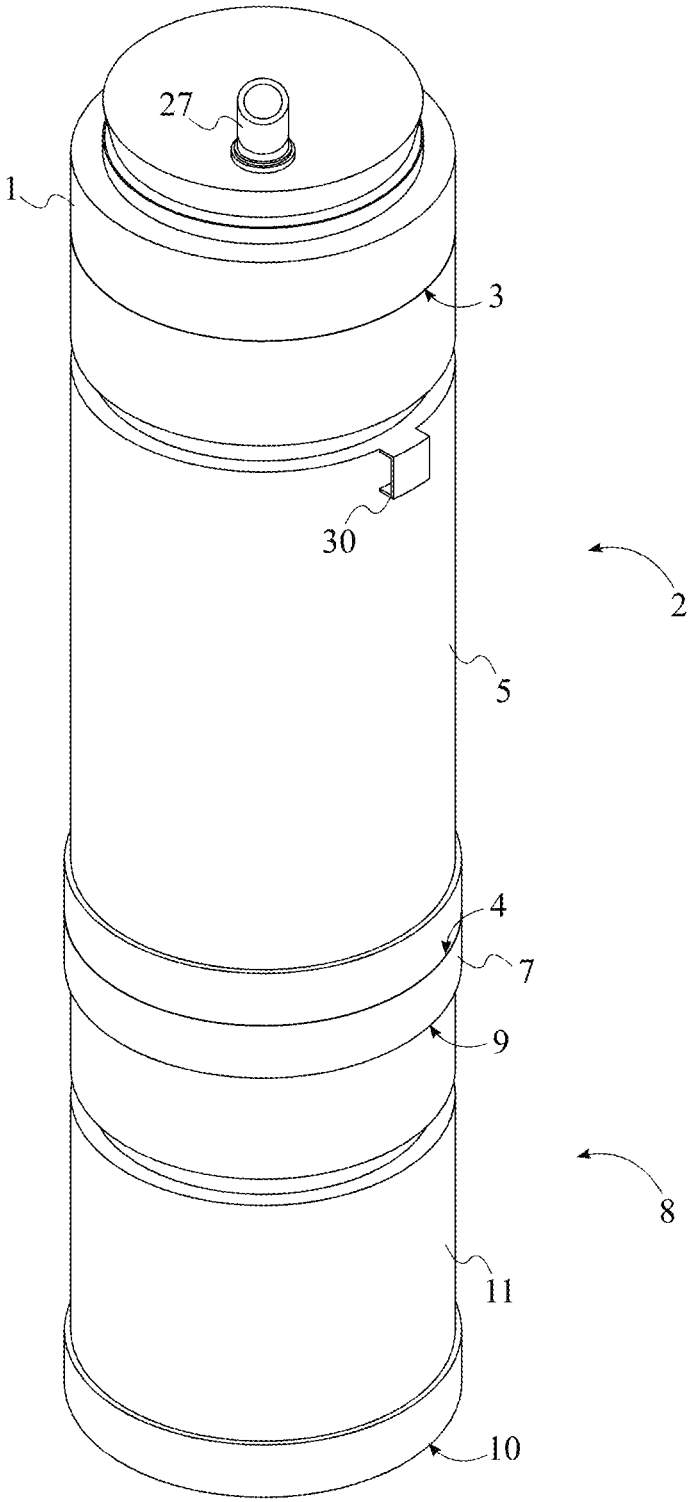
FIG. 3 is a top-front-left perspective view of the present invention, wherein the present invention is shown in the storage configuration.

The present invention is a modular beverage container assembly designed to store different beverages and/or beverage ingredients separate from each other in the same modular structure. As can be seen in FIGS. 1 through 3, the present invention preferably comprises a drinking lid 1, a solvent receptacle 2, a dispensing cap 7, a solute container 8, a lid-interlocking snap feature 13, a receptacle-interlocking snap feature 15, a cap-interlocking snap feature 17, and a container-interlocking snap feature 19. The drinking lid 1 enables the consumption of the desired beverage from the solvent receptacle 2. The solvent receptacle 2 retains the liquid that can be used as the liquid base to mix the desired beverage. The solvent receptacle 2 also facilitates the mixing of the desired beverage. The dispensing cap 7 enables the controlled dispensing of the desired beverage ingredients from the solute container 8 into the solvent receptacle 2. The solute container 8 stores the beverage ingredients separately from the liquid base in the solvent receptacle 2 so that the user can selectively mix the desired beverage ingredients with the liquid base to make the desired beverage. The lid-interlocking snap feature 13 and the receptacle-interlocking snap feature 15 enable the attachment of the drinking lid 1 to the solvent receptacle 2 in a quick-release manner. Similarly, the cap-interlocking snap feature 17 and the container-interlocking snap feature 19 enable the attachment of the dispensing cap 7 to the solute container 8 in a quick-release manner.

The general configuration of the aforementioned components enables the user to carry the necessary ingredients to make a desired beverage on the go without having to carry several separate storage containers. As previously mentioned, the solvent receptacle 2 and the solute container 8 are designed to retain the necessary ingredients to make the desired beverage. Both the solvent receptacle 2 and the solute container 8 are preferably elongated cylindrical structures designed to retain a certain amount of beverage ingredients. As can be seen in FIGS. 1 through 3 and 13 through 16, the solvent receptacle 2 comprises an open receptacle end 3, a closed receptacle end 4, a receptacle lateral wall 5, and a plurality of receptacle partitions 6. The open receptacle end 3 and the closed receptacle end 4 correspond to the opposite cylindrical bases of the solvent receptacle 2, while the receptacle lateral wall 5 corresponds to the cylindrical wall of the solvent receptacle 2. The receptacle lateral wall 5 is preferably an insulated structure able to keep the stored liquid bases hot or cold for a prolonged period. The plurality of receptacle partitions 6 include several radial partitions within the solvent receptacle 2 that store predetermined amounts of the liquid base that can be used to make the desired beverage. Similarly, the solute container 8 comprises an open container end 9, a closed container end 10, a container lateral wall 11, and a plurality of container partitions 12. The open container end 9 and the closed container end 10 correspond to the opposite cylindrical bases of the solute container 8, while the container lateral wall 11 corresponds to the cylindrical wall of the solute container 8. Like the receptacle lateral wall 5, the container lateral wall 11 is preferably an insulated structure able to keep the stored beverage ingredients hot or cold for a prolonged period. The plurality of container partitions 12 also include several radial partitions within the solute container 8 that stores predetermined amounts of beverage ingredients that can be used to make the desired beverage.

In the preferred embodiment, the present invention can be arranged as follows: the lid-interlocking snap feature 13 is integrated around the drinking lid 1 to facilitate the removable attachment of the drinking lid 1 to the solvent receptacle 2, as can be seen in FIGS. 1 through 3. The plurality of receptacle partitions 6 is mounted within the receptacle lateral wall 5 in between the open receptacle end 3 and the closed receptacle end 4 to provide separate storage spaces that can hold separate amounts of the desired liquid base (e.g., warm water to make baby formula). Further, the receptacle-interlocking snap feature 15 is integrated around the open receptacle end 3 to engage the lid-interlocking snap feature 13 which allows the removable attachment of the drinking lid 1 to the solvent receptacle 2. Similarly, the cap-interlocking snap feature 17 is integrated around the dispensing cap 7 to facilitate the removable attachment of the dispensing cap 7 to the solute container 8. The plurality of container partitions 12 is also mounted within the container lateral wall 11 in between the open container end 9 and the closed container end 10 to provide separate storage spaces that can hold separate amounts of beverage ingredients (e.g., infant formula powder). Furthermore, the container-interlocking snap feature 19 is integrated around the open container end 9 to engage the cap-interlocking snap feature 17 which allows the removable attachment of the dispensing cap 7 to the solute container 8.

As can be seen in FIGS. 3 through 12, the modularity of the present invention allows the arrangement of the modular components into different configurations. Each of the modular components of the present invention can be easily detached to facilitate the different functions of the present invention, such as allowing the mixing of the desired beverage ingredients to make the desired beverage. So, the drinking lid 1, the solvent receptacle 2, the dispensing cap 7, and the solute container 8 are operatively mounted to each other, wherein the drinking lid 1, the solvent receptacle 2, the dispensing cap 7, and the solute container 8 are arranged between a storage configuration, a refill-solute configuration, a refill-solvent configuration, a drinking configuration, and a mixing configuration. In the preferred embodiment, the storage configuration corresponds to the configuration where the present invention is arranged to store the beverage ingredients separately until the user is ready to make the desired beverage. In the refill-solute configuration and the refill-solvent configuration, the solute container 8 and the solvent receptacle 2 are exposed to allow the refilling of the beverage ingredients and the liquid base, respectively. In the mixing configuration, the present invention is arranged so that user can dispense the selected beverage ingredients from the solute container 8 into the select liquid base in the solvent receptacle 2 to make the desired beverage. In the drinking configuration, the present invention is arranged to allow the user to consume the mixed beverage. In other embodiments, the modularity of the present invention can allow for different configurations to be implemented to facilitate different functions.

As previously discussed, the storage configuration allows the separate storage of the liquid base and the beverage ingredients in a single modular assembly. As can be seen in FIGS. 1 through 3, the assembled present invention preferably forms an overall elongated cylindrical structure that can be easily carried by the user. To enable the formation of a single cylindrical structure, the present invention may further comprise a first twist-locking feature 21 and a second twist-locking feature 24 that enable the removable connection of the dispensing cap 7 to the solvent receptacle 2. In the storage configuration, the first twist-locking feature 21 is integrated around the closed receptacle end 4, while the second twist-locking feature 24 is integrated around the dispensing cap 7, offset from the cap-interlocking snap feature 17. The first twist-locking feature 21 and the second twist-locking feature 24 are designed to be securely engaged to each other in a radial manner. So, to form the single cylindrical assembly, the lid-interlocking snap feature 13 and the receptacle-interlocking snap feature 15 are rotatably engaged to each other to secure the drinking lid 1 cap to the solvent receptacle 2. In addition, the first twist-locking feature 21 and the second twist-locking feature 24 are torsionally engaged to each other to secure the dispensing cap 7 to the solvent receptacle 2, opposite the drinking lid 1. Furthermore, the cap-interlocking snap feature 17 and the container-interlocking snap feature 19 are rotatably engaged to each other to secure the solute container 8 to the dispensing cap 7. As a result, a single elongated cylindrical structure that is easy to transport and store is formed.

As can be seen in FIGS. 1 through 3, 9, and 10, the first twist-locking feature 21 and the second twist-locking feature 24 are designed to enable the detachable fastening of the dispensing cap 7 to the solvent receptacle 2. In the preferred embodiment, the first twist-locking feature 21 comprises a cylindrical recessed space 22 and a plurality of hooks 23, while the second twist-locking feature 24 comprises a cylindrical protrusion 25 and a plurality of slots 26. The cylindrical recessed space 22 is formed on the closed receptacle end 4 to accommodate the cylindrical protrusion 25 on the dispensing cap 7. The plurality of hooks 23 and the plurality of slots 26 are designed so that the plurality of hooks 23 can be first axially aligned by inserting the cylindrical protrusion 25 into the cylindrical recessed space 22. Then, the plurality of slots 26 is rotated by rotating the dispensing cap 7 until the plurality of hooks 23 is engaged with the plurality of slots 26. Thus, the dispensing cap 7 can be attached to the solvent receptacle 2 in a quick-release manner to secure both the dispensing cap 7 and the attached solute container 8, to the solvent receptacle 2.

As can be seen in FIGS. 1 through 3, 9, and 10, the cylindrical recessed space 22 traverses into the closed receptacle end 4 to form a space large enough to match the shape and size of the cylindrical protrusion 25. Further, the plurality of hooks 23 is peripherally connected to the closed receptacle end 4 within the cylindrical recessed space 22 to integrate the plurality of hooks 23 into the cylindrical recessed space 22. Moreover, the cylindrical protrusion 25 is connected onto the dispensing cap 7, opposite to the cap-interlocking snap feature 17, to integrate the cylindrical protrusion 25 on the dispensing cap 7. Further, the plurality of slots 26 is laterally integrated around the cylindrical protrusion 25 to implement the plurality of slots 26 on the cylindrical protrusion 25. Furthermore, each of the plurality of hooks 23 is engaged into a corresponding slot of the plurality of slots 26 to secure the dispensing cap 7 to the solvent receptacle 2 in a quick-release manner.

Figure 4:
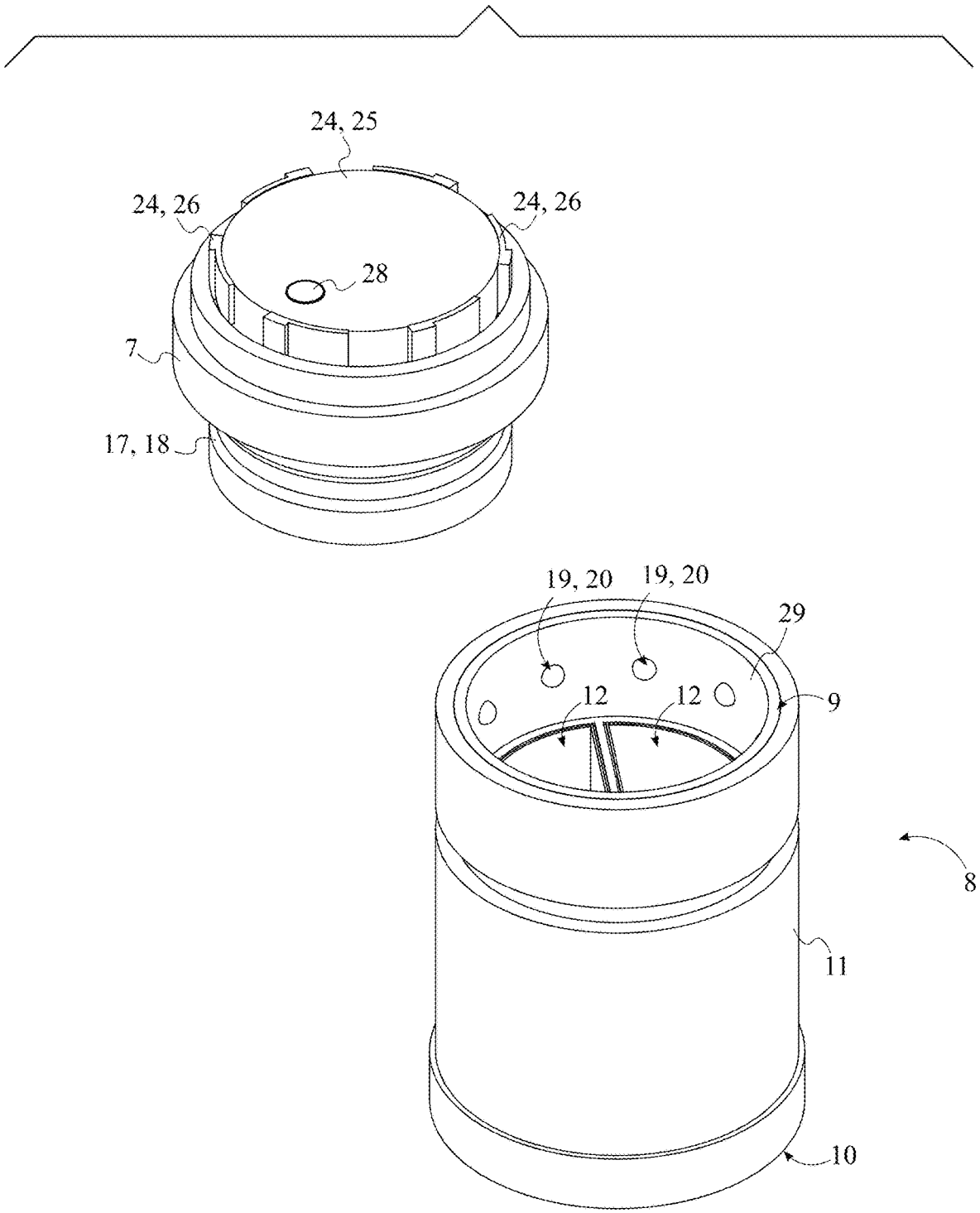
FIG. 4 is a top-front-left perspective view of the dispensing cap and the solute container of the present invention, wherein the present invention is shown in the refill-solute configuration.
Figure 5:
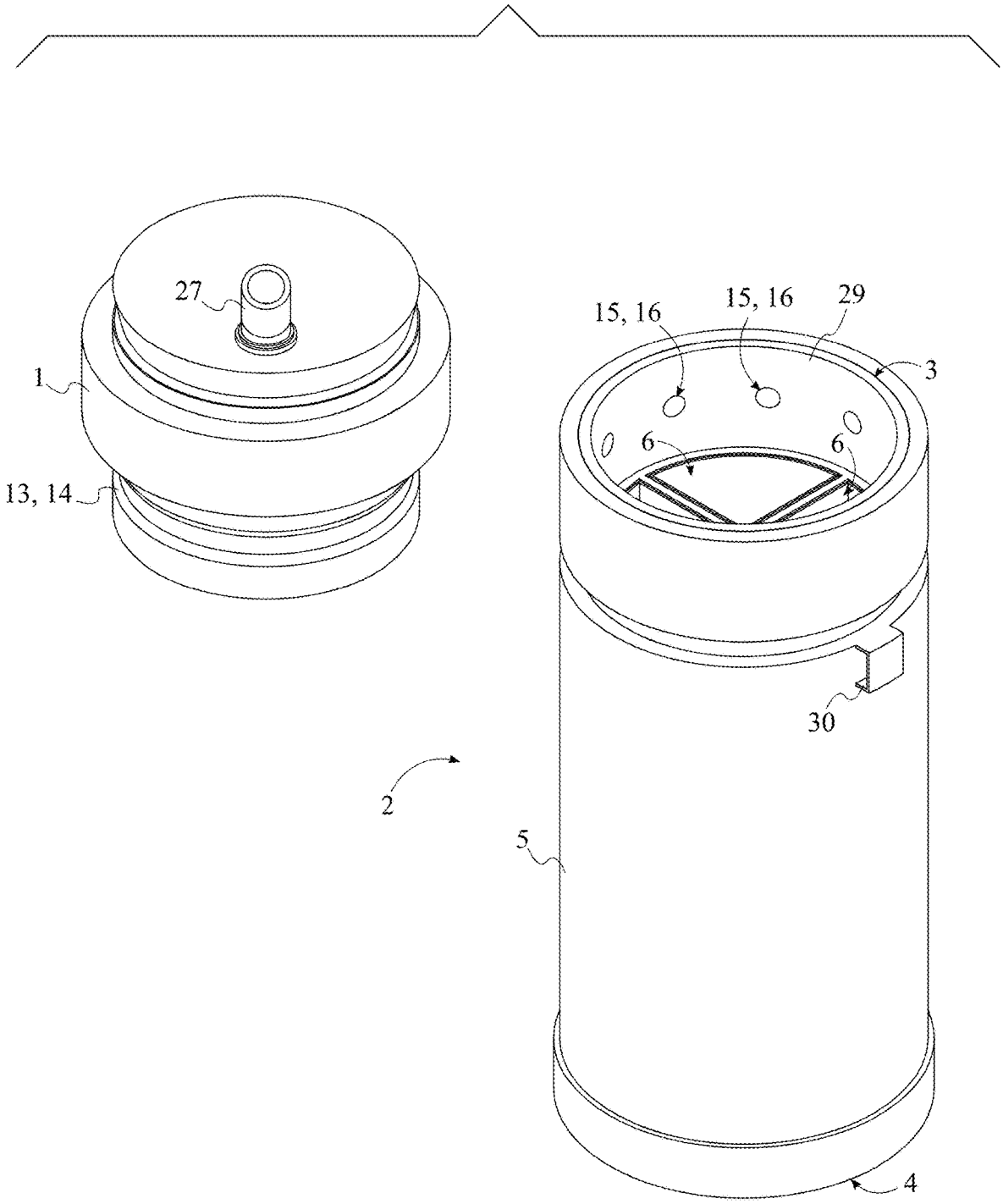
FIG. 5 is a top-front-left perspective view of the drinking lid and the solvent receptacle of the present invention, wherein the present invention is shown in the refill-solvent configuration.

As previously discussed, the refill-solute configuration and the refill solvent configuration enable the refill of the beverage ingredients and the beverage base in the solvent receptacle 2 and the solute container 8, respectively. As can be seen in FIG. 4, to facilitate the refilling of beverage ingredients, the cap-interlocking snap feature 17 and the container-interlocking snap feature 19 are positioned offset from each other in the refill-solute configuration. This way, the open container end 9 is exposed so that the user can refill the beverage ingredients in each of the plurality of container partitions 12. Similarly, in the refill-solvent configuration, the lid-interlocking snap feature 13 and the receptacle-interlocking snap feature 15 are positioned offset from each other, as can be seen in FIG. 5. This way, the open receptacle end 3 is exposed so that the user can refill each of the plurality of receptacle partitions 6 with the liquid base. In other embodiments, different mechanisms can be implemented to enable the refilling of the liquid base and the beverage ingredients.

Figure 6:
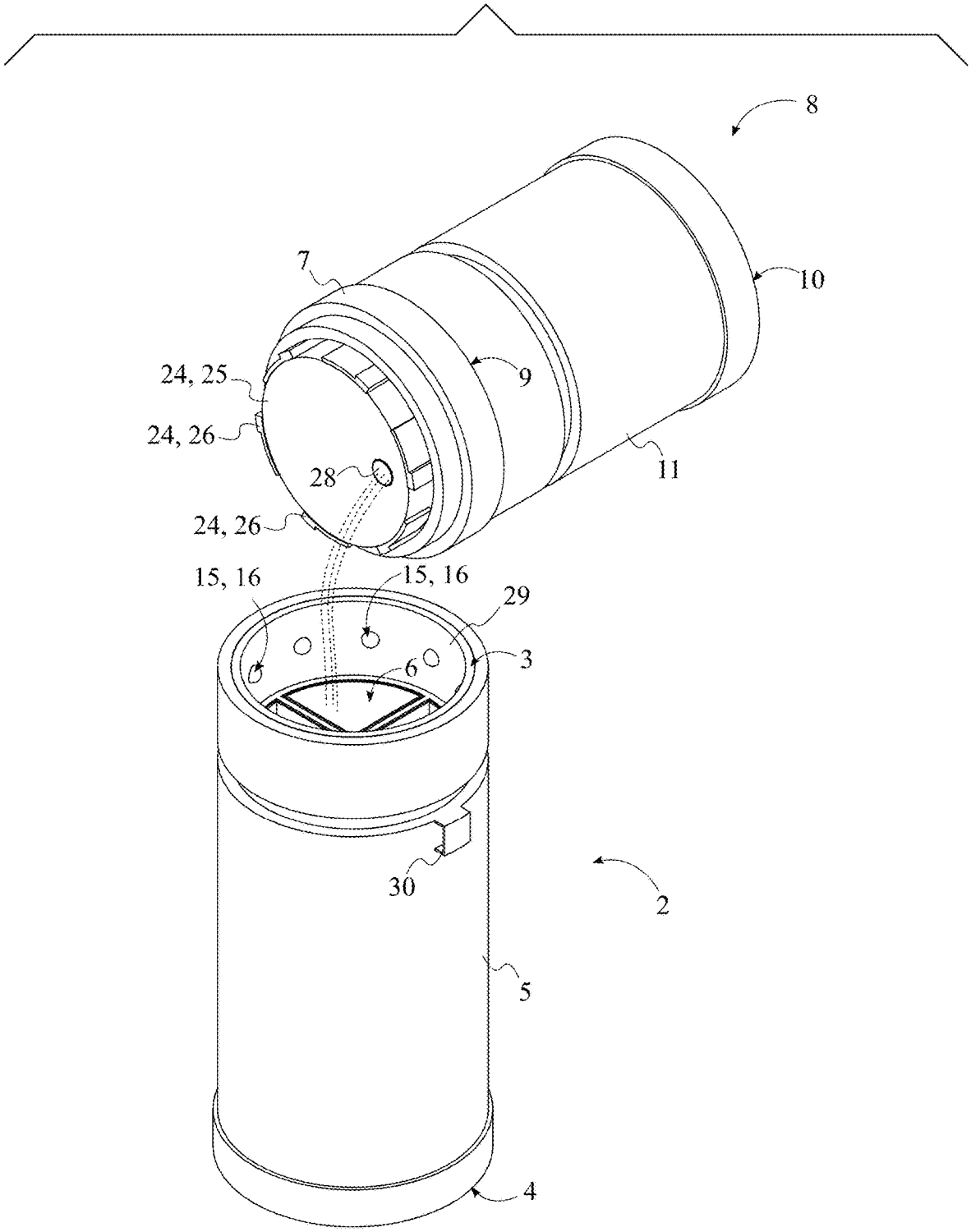
FIG. 6 is a top-front-left perspective view of the dispensing cap, the solute container, and the solvent receptacle of the present invention, wherein the present invention is shown in the mixing configuration.

As can be seen in FIG. 6, to enable the preparation of the desired beverage, the present invention may further comprise a dispensing channel 28 that facilitates the controlled dispensing of the selected beverage ingredient from the solute container 8 into the selected liquid based in the solvent receptacle 2. The dispensing channel 28 traverses through the dispensing cap 7 to form a space large enough for the beverage ingredients to pass through. In addition, the dispensing channel 28 is peripherally positioned to the dispensing cap 7 to facilitate the pouring of the selected beverage ingredients into the selected container partition that holds the desired liquid base. Then, the cap-interlocking snap feature 17 and the container-interlocking snap feature 19 are operatively engaged to each other, wherein the cap-interlocking snap feature 17 and the container-interlocking snap feature 19 are used to incrementally rotate the dispensing cap 7 in relation to the solvent container. In other words, the dispensing cap 7 can be rotated to allow the select dispensing of beverage ingredients in a container partition without the other beverage ingredients in the other container partitions leaking.

Figure 7:
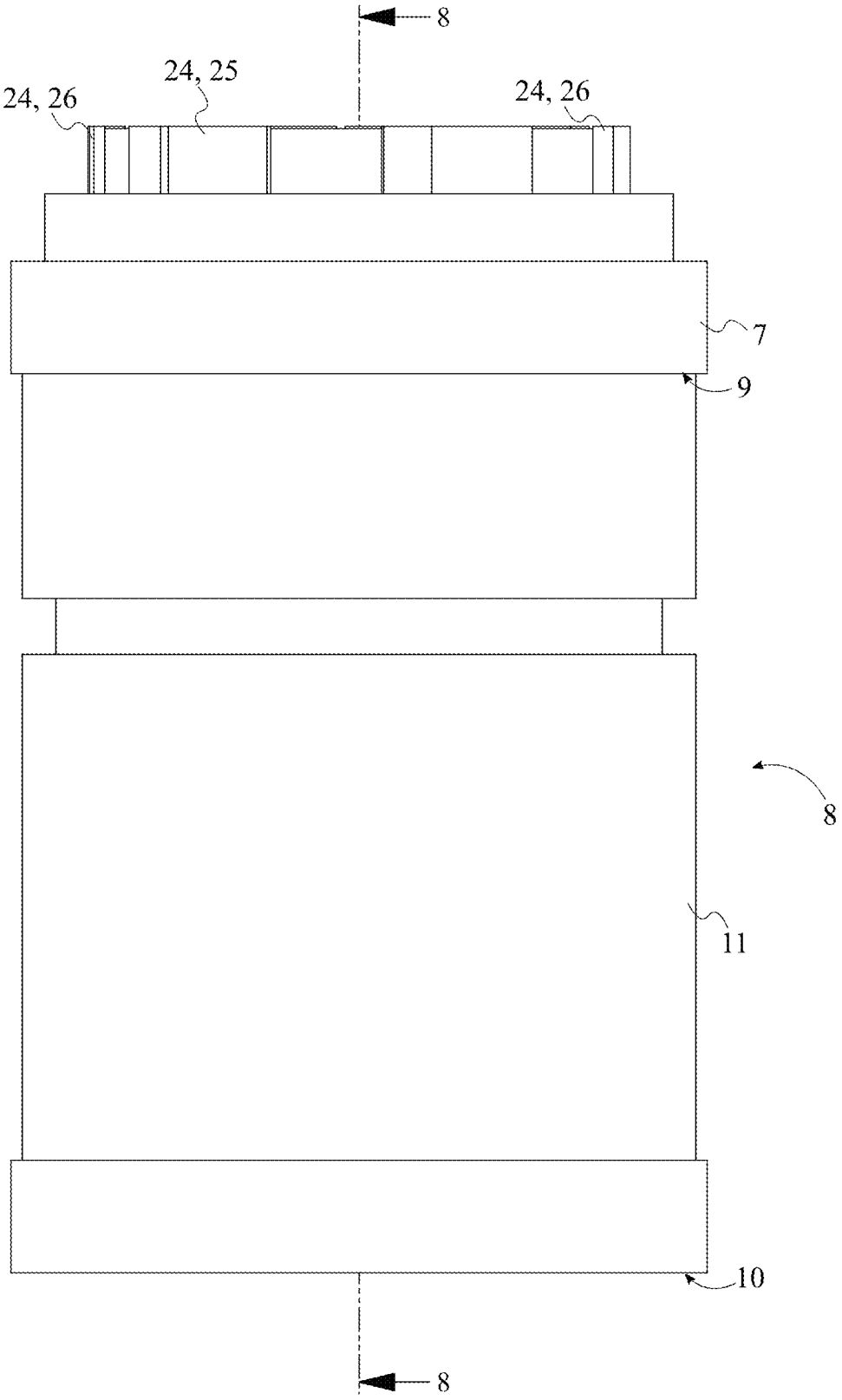
FIG. 7 is a front view of the solute container and the dispensing cap of the present invention.
Figure 8:
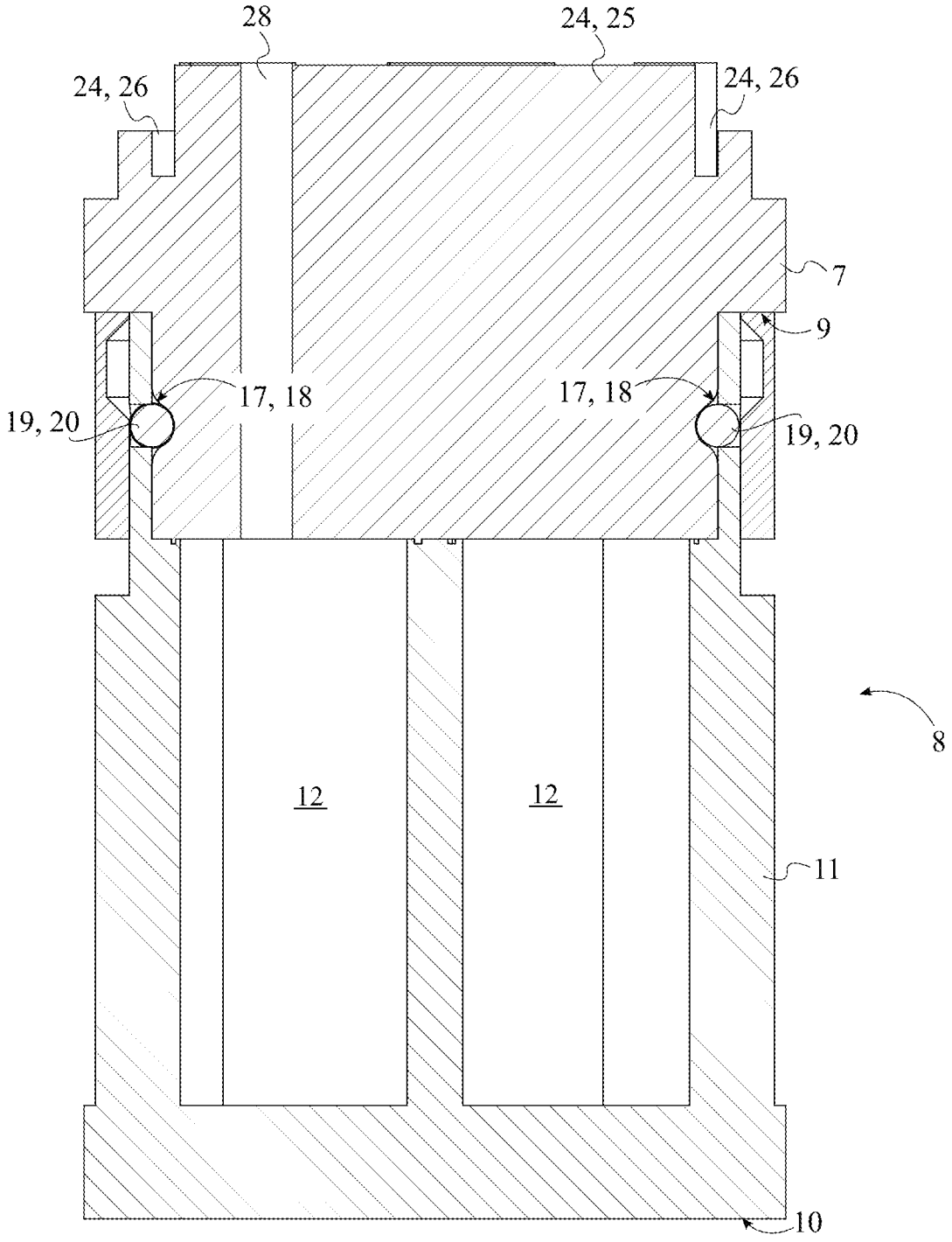
FIG. 8 is a vertical cross-sectional view of the present invention taken along line 8-8 in FIG. 7.
Figure 9:
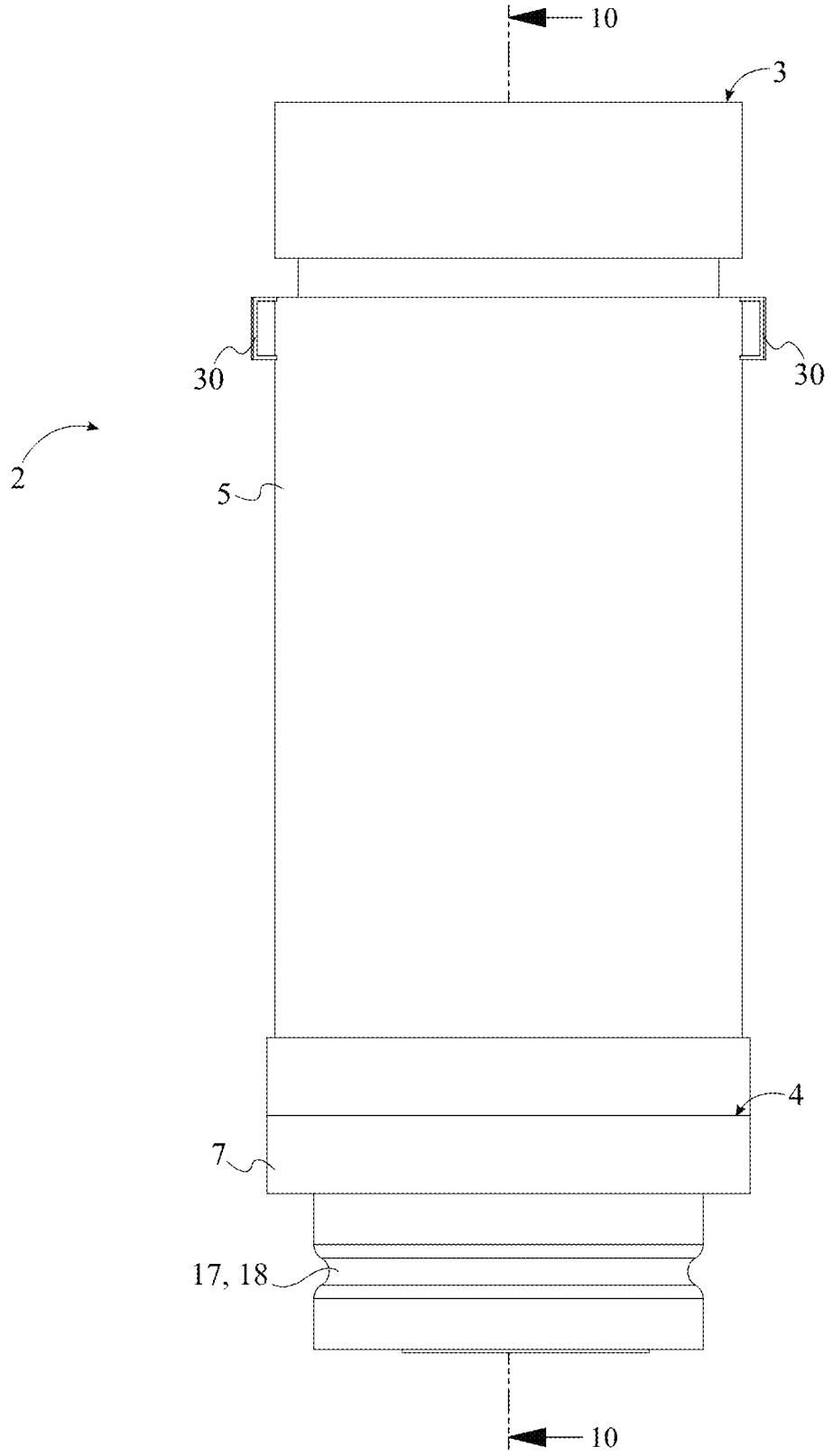
FIG. 9 is a front view of the solvent receptacle and the dispensing cap of the present invention.
Figure 10:
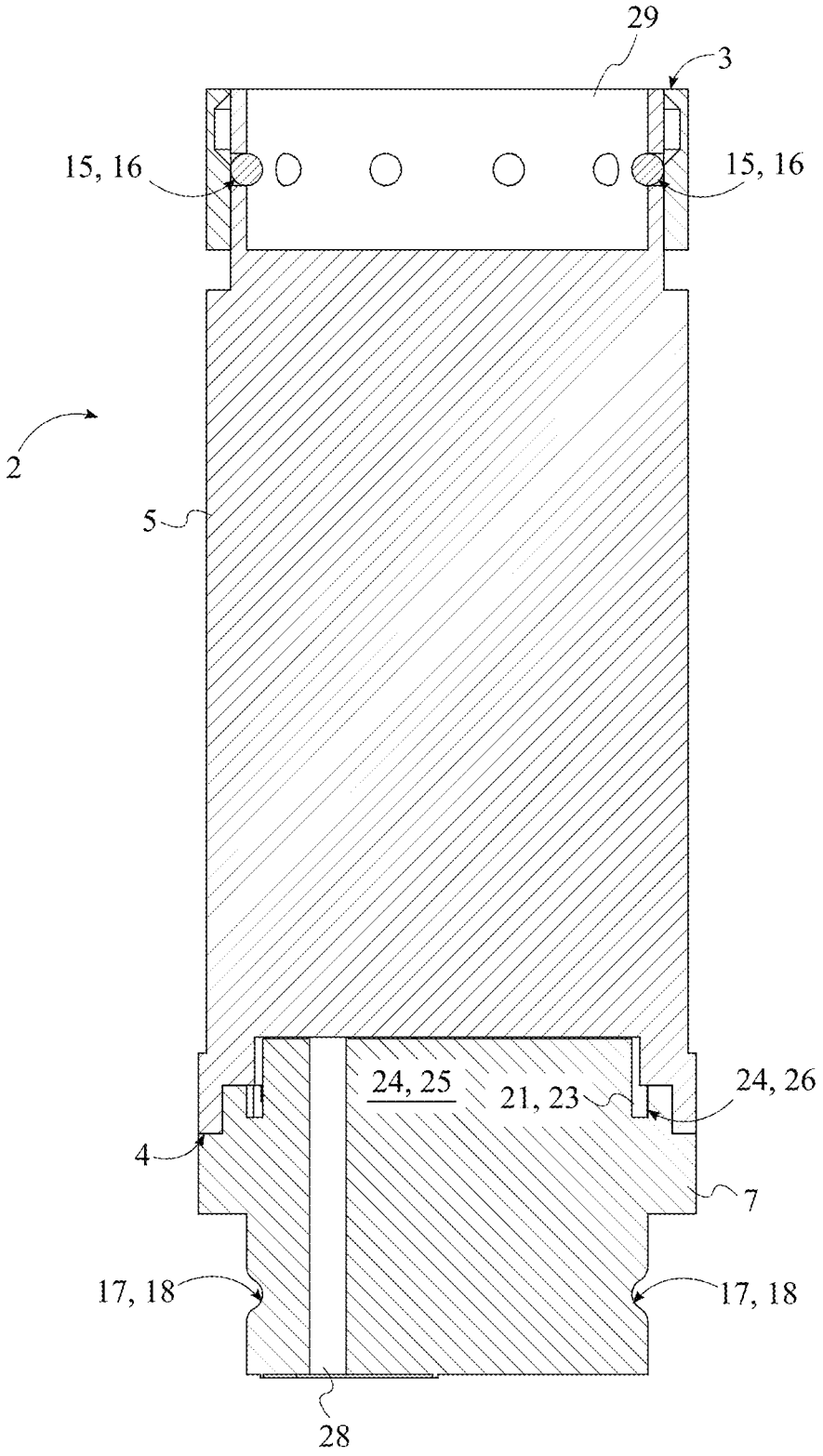
FIG. 10 is a vertical cross-sectional view of the present invention taken along line 10-10 in FIG. 9.

As can be seen in FIG. 6 through 8, when dispensing the selected beverage ingredients, the dispensing channel 28 is in fluid communication with a selected container partition from the plurality of container partitions 12. A rubber seal with the same shape and size as the opening of the selected container partition can be implemented on the side of the dispensing cap 7 opposite to the cylindrical protrusion 25. In addition, a seal channel is implemented around each opening of the plurality of container partitions 12. This way, as the dispensing cap 7 is rotated, the rubber seal engages with the seal channel on the selected container partition to form a temporary hermetical connection that prevents undesired mixing of beverage ingredients in the plurality of container partitions 12. Furthermore, the lid-interlocking snap feature 13 and the receptacle-interlocking snap feature 15 are positioned offset from each other to expose the open receptacle end 3. This way, the user can pour the beverage ingredients from the selected container partition into the liquid base in the selected receptacle partition to mix the desired beverage that is to be consumed.

Figure 11:
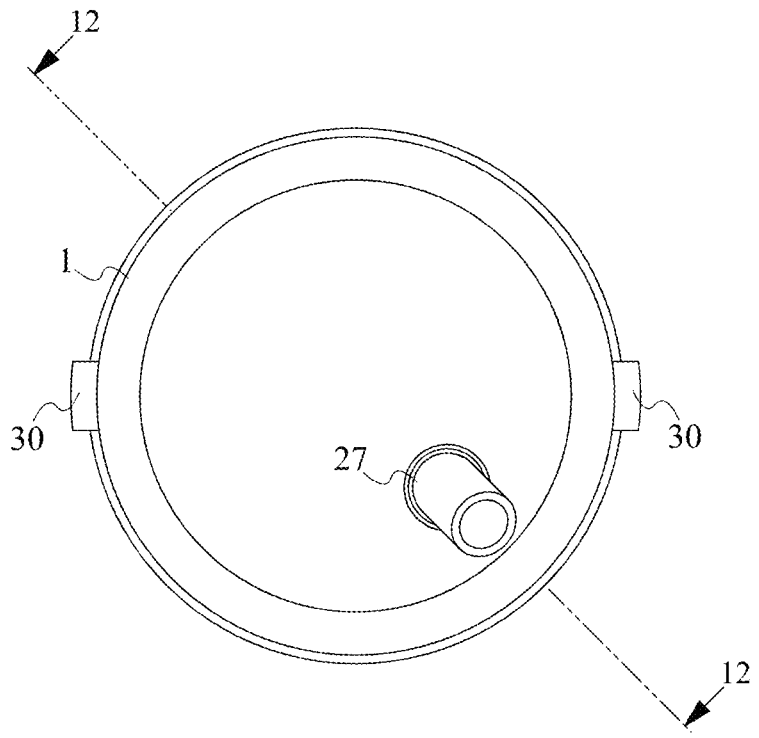
FIG. 11 is a top view of the solvent receptacle and the drinking lid of the present invention, wherein the present invention is shown in drinking configuration.
Figure 12:
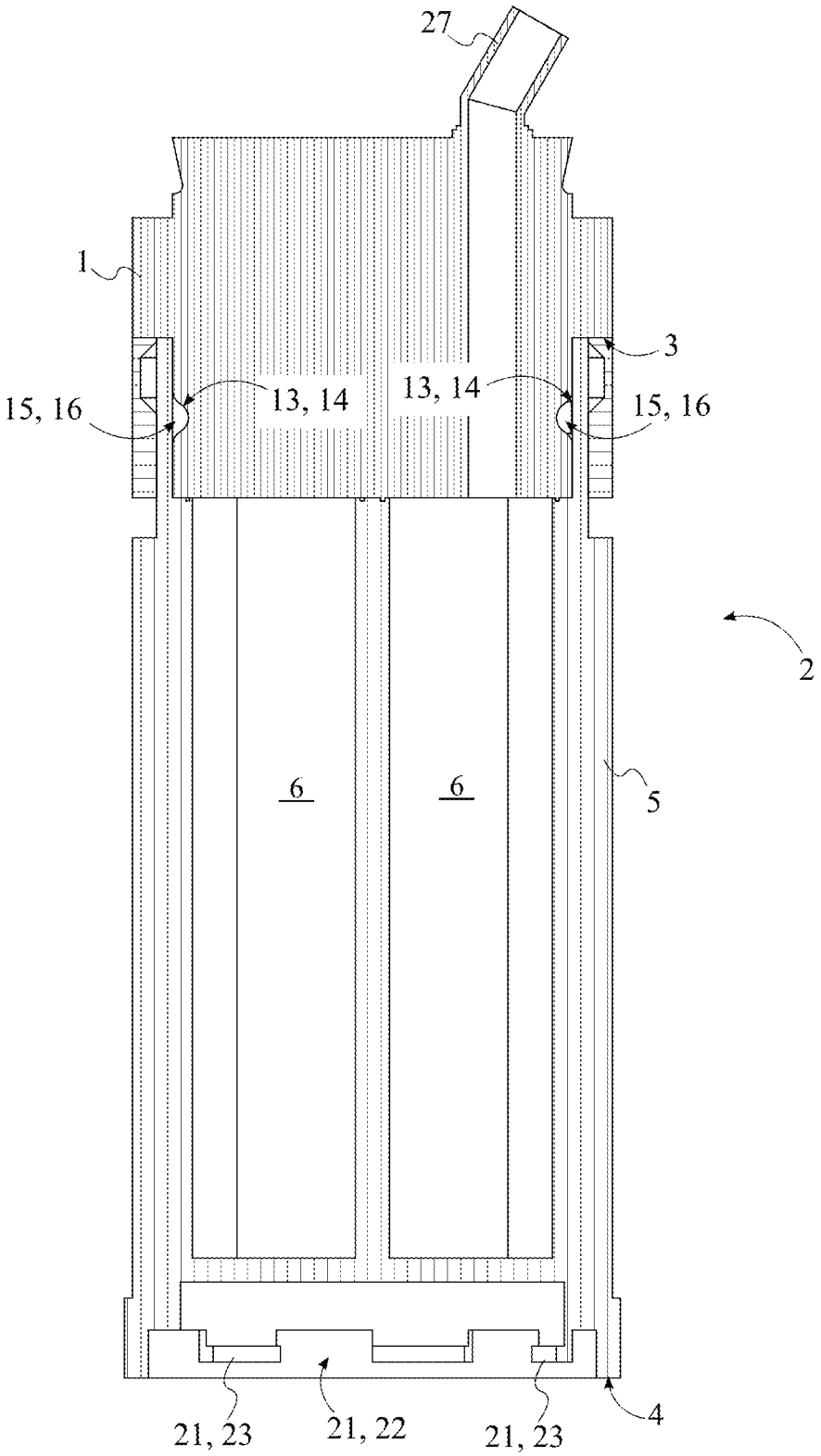
FIG. 12 is a vertical cross-sectional view of the present invention taken along line 12-12 in FIG. 11.
Figure 13:
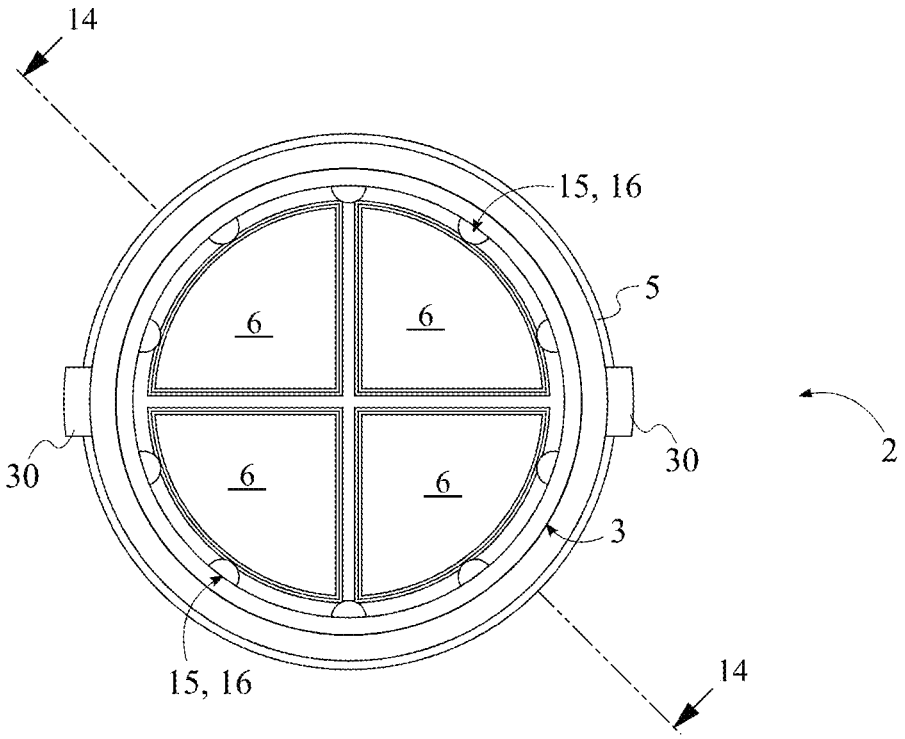
FIG. 13 is a top view of the solvent receptacle of the present invention.
Figure 14:
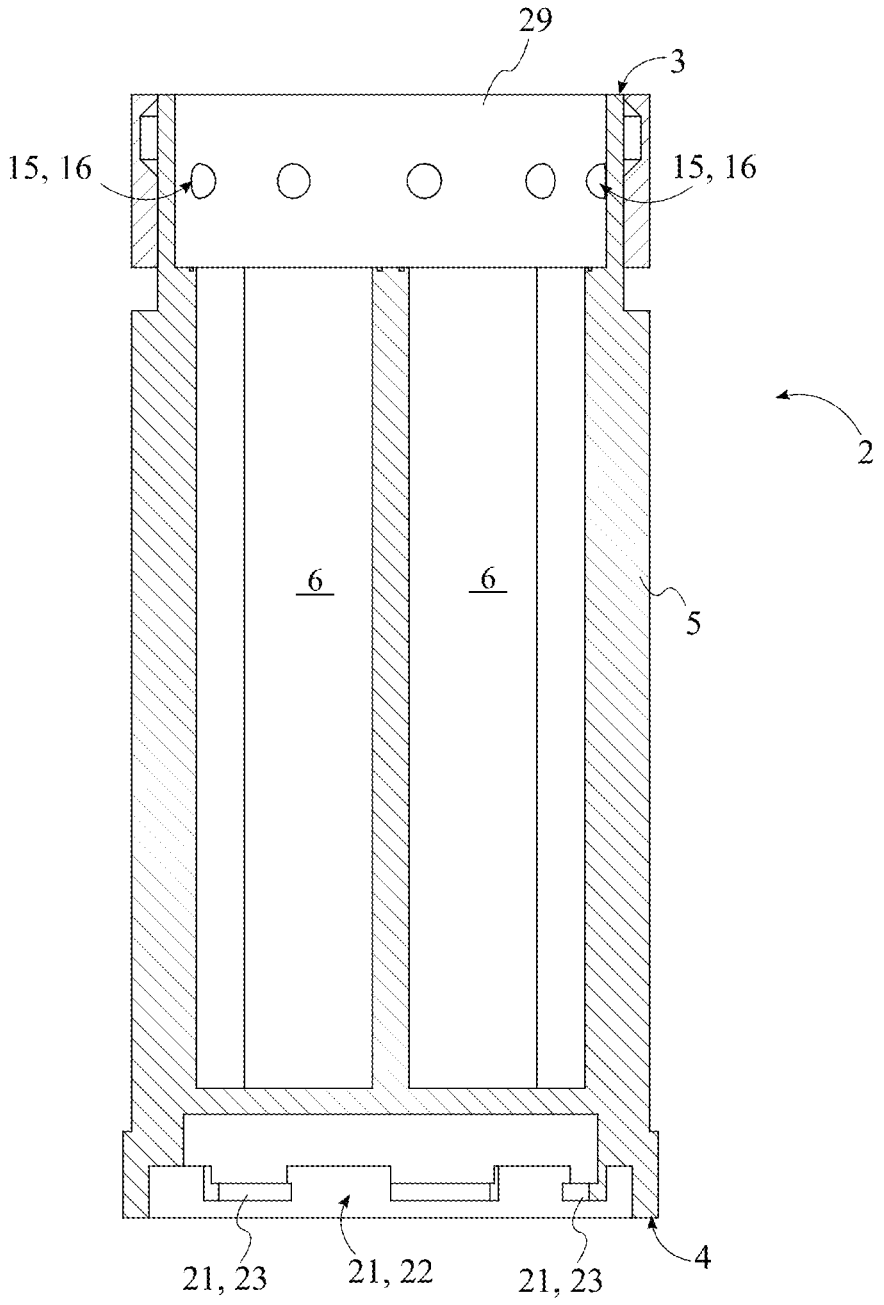
FIG. 14 is a vertical cross-sectional view of the present invention taken along line 14-14 in FIG. 13.
Figure 15:
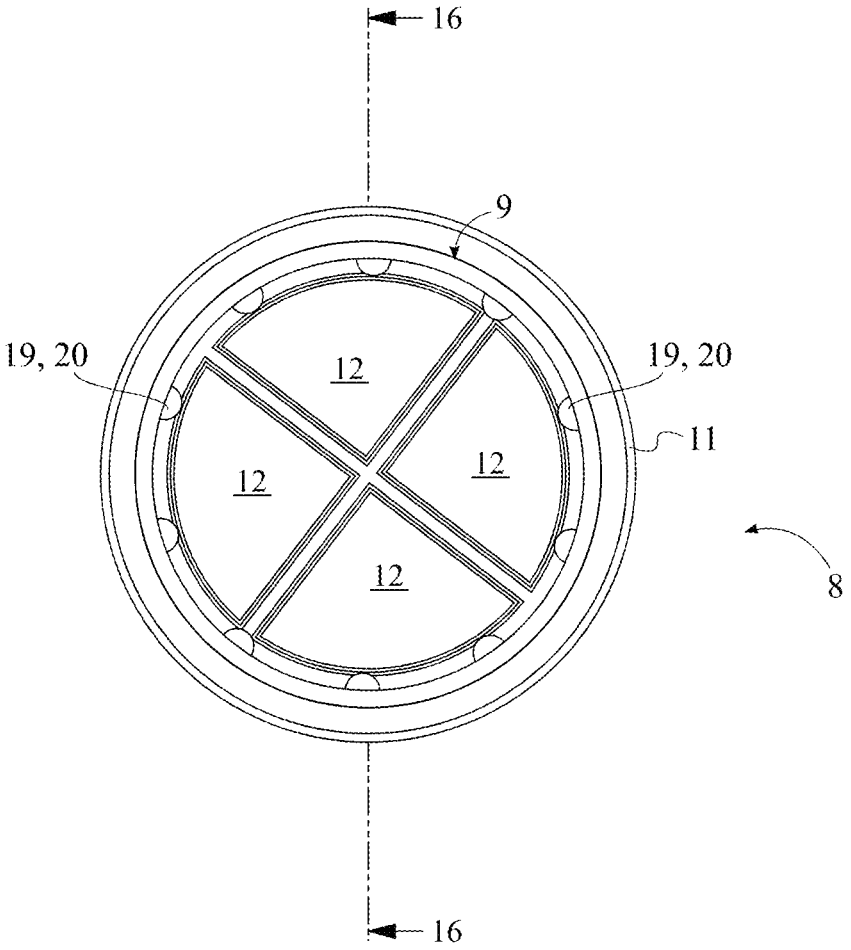
FIG. 15 is a top view of the solute container of the present invention.
Figure 16:
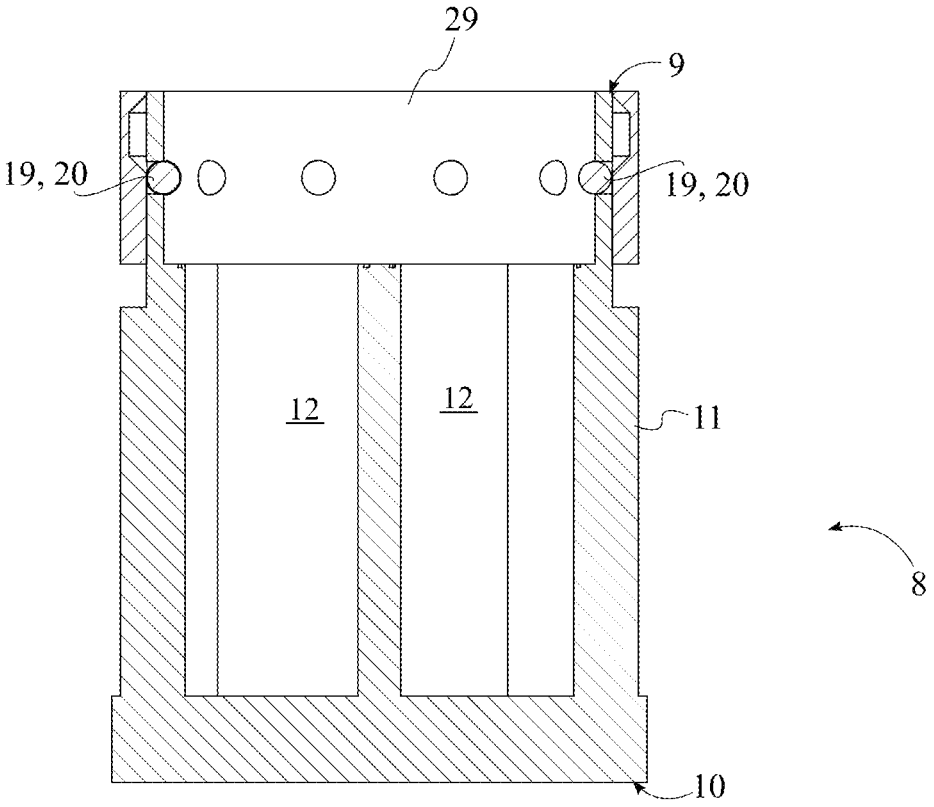
FIG. 16 is a vertical cross-sectional view of the present invention taken along line 16-16 in FIG. 15.

As can be seen in FIGS. 11 and 12, in order to facilitate the consumption of the prepared beverage, the present invention may further comprise a drinking spout 27 that allows the user to consume the desired beverage from the solvent receptacle 2. The drinking spout 27 is designed to enable the direct consumption of the mixed beverage from the selected receptacle partition. For example, the drinking spout 27 can be a straw-like structure that allows the user to consume the mixed beverage via suction. To do so, the drinking spout 27 is integrated through the drinking lid 1 to implement the drinking spout 27 in the drinking lid 1. In addition, the drinking spout 27 is peripherally positioned to the drinking lid 1 to match the position of the selected receptacle partition. Further, the lid-interlocking snap feature 13 and the receptacle-interlocking snap feature 15 are operatively engaged to each other, wherein the lid-interlocking snap feature 13 and the receptacle-interlocking snap feature 15 are used to incrementally rotate the drinking lid 1 in relation to the solute receptacle.

Similar to the dispensing cap 7, the drinking lid 1 can be rotated to align the drinking spout 27 with the selected receptacle partition holding the mixed beverage. As can be seen in FIGS. 11 and 12, when consuming the mixed beverage, the drinking spout 27 is in fluid communication with the selected receptacle partition from the plurality of receptacle partitions 6. Like before, a rubber seal with the same shape and size as the opening of the selected receptacle partition can be implemented on the side of the drinking lid 1 opposite to the drinking spout 27. In addition, a seal channel is implemented around each opening of the plurality of receptacle partitions 6. This way, as the drinking lid 1 is rotated, the rubber seal engages with the seal channel on the selected receptacle partition to form a temporary hermetical connection that prevents undesired mixing of the liquid bases in the plurality of receptacle partitions 6. Furthermore, the user can consume the mixed beverage with the dispensing cap 7 and the solute container 8 either attached to the solvent receptacle 2 or detached from the solvent receptacle 2. In other embodiments, different mechanisms can be implemented to facilitate the consumption of the mixed beverage.

As previously discussed, the lid-interlocking snap feature 13 and the receptacle-interlocking snap feature 15 enable the removable attachment of the drinking lid 1 to the solvent receptacle 2 while enabling the rotation of the drinking lid 1 on the open receptacle end 3. As can be seen in FIGS. 1, 2, and 11 through 14, the lid-interlocking snap feature 13 comprises an annular lid recessed space 14 and the receptacle-interlocking snap feature 15 comprises a plurality of receptacle spring-loaded spherical bearings 16. The plurality of receptacle spring-loaded spherical bearings 16 includes several spring-loaded spherical bearings that protrude to engage the annular lid recessed space 14 and retract to release the annular lid recessed space 14. So, the annular lid recessed space 14 is laterally integrated into the drinking lid 1 to form an annular space that engages the plurality of receptacle spring-loaded spherical bearings 16. Moreover, the plurality of receptacle spring-loaded spherical bearings 16 is integrated around and into an inner annular surface 29 of the open receptacle end 3. Further, each of the plurality of receptacle spring-loaded spherical bearings 16 is implemented so that each receptacle spring-loaded spherical bearing can recede into the receptacle lateral wall 5. The plurality of receptacle spring-loaded spherical bearings 16 also normally protrude into the space within the receptacle lateral wall 5 to engage the annular lid recessed space 14 when no external force is applied. Each of the plurality of receptacle spring-loaded spherical bearings 16 is engaged into the annular lid recessed space 14 to securely attached the drinking lid 1 into the open receptacle end 3.

As can be seen in FIGS. 1, 2, and 11 through 14, the plurality of receptacle spring-loaded spherical bearings 16 can be implemented in different ways. For example, cylindrical spaces on the receptacle lateral wall 5 can be formed to allow the corresponding receptacle spring-loaded spherical bearing to completely recede into the receptacle lateral wall 5. In this embodiment, a strong force must be applied to remove the drinking lid 1 from the open receptacle end 3 as well as to engage the drinking lid 1 into the open receptacle end 3. Alternatively, a spring-loaded sleeve that can be engaged by the user can be externally implemented around the open receptacle end 3. The spring-loaded sleeve is designed so that when the spring-loaded sleeve is engaged, the spring-loaded sleeve moves the receptacle spring-loaded spherical bearings into the inside the receptacle lateral wall 5. This allows the plurality of receptacle spring-loaded spherical bearings 16 to engage the annular lid recessed space 14. On the other hand, when the spring-loaded sleeve is disengaged, the spring-loaded sleeve provides space for the receptacle spring-loaded spherical bearings to recede into the receptacle lateral wall 5. In other embodiments, the plurality of receptacle spring-loaded spherical bearings 16 can be implemented using different mechanisms.

Likewise, the cap-interlocking snap feature 17 and the container-interlocking snap feature 19 enable the removable attachment of the dispensing cap 7 to the solute container 8 while enabling the rotation of the dispensing cap 7 on the open container end 9. As can be seen in FIGS. 1, 2, and 11 through 14, the cap-interlocking snap feature 17 comprises an annular cap recessed space 18 and the container-interlocking snap feature 19 comprises a plurality of container spring-loaded spherical bearings 20. The plurality of container spring-loaded spherical bearings 20 includes several spring-loaded spherical bearings that protrude to engage the annular cap recessed space 18 and retract to release the annular cap recessed space 18. So, the annular cap recessed space 18 is laterally integrated into the dispensing cap 7 to form an annular space that engages the plurality of container spring-loaded spherical bearings 20. Moreover, the plurality of container spring-loaded spherical bearings 20 is integrated around and into an inner annular surface 29 of the open container end 9. Further, each of the plurality of container spring-loaded spherical bearings 20 is implemented so that each container spring-loaded spherical bearing can recede into the container lateral wall 11. The plurality of container spring-loaded spherical bearings 20 also normally protrude into the space within the container lateral wall 11 to engage the annular cap recessed space 18 when no external force is applied. Each of the plurality of container spring-loaded spherical bearings 20 is engaged into the annular cap recessed space 18 to securely attached the dispensing cap 7 into the open container end 9.

As can be seen in FIGS. 1, 2, and 11 through 14, the plurality of container spring-loaded spherical bearings 20 can be implemented in different ways similar to the plurality of receptacle spring-loaded spherical bearings 16. For example, cylindrical spaces on the container lateral wall 11 can be formed to allow the corresponding container spring-loaded spherical bearing to completely recede into the container lateral wall 11. In this embodiment, a strong force must be applied to remove the dispensing cap 7 from the open container end 9 as well as to engage the dispensing cap 7 into the open container end 9. Alternatively, a spring-loaded sleeve that can be engaged by the user can be externally implemented around the open container end 9. The spring-loaded sleeve is designed so that when the spring-loaded sleeve is engaged, the spring-loaded sleeve moves the container spring-loaded spherical bearings into the inside the container lateral wall 11. This allows the plurality of container spring-loaded spherical bearings 20 to engage the annular cap recessed space 18. On the other hand, when the spring-loaded sleeve is disengaged, the spring-loaded sleeve provides space for the container spring-loaded spherical bearings to recede into the container lateral wall 11. In other embodiments, the plurality of container spring-loaded spherical bearings 20 can be implemented using different mechanisms.

In the preferred embodiment, to enable the user to comfortably carry the present invention in the storage configuration, the present invention may further comprise a plurality of strap-anchoring features 30, as can be seen in FIGS. 1 through 3, 9, and 13. The plurality of strap-anchoring features 30 enables a strap or other tethers to be secured to the present invention so that the present invention in the storage configuration can be carried using the tether. So, the plurality of strap-anchoring features 30 is preferably distributed around the receptacle lateral wall 5 to position the plurality of strap-anchoring features 30 on the exterior of the solvent receptacle 2. Further, the plurality of strap-anchoring features 30 is laterally connected to the receptacle lateral wall 5 to integrate the plurality of strap-anchoring features 30 onto the solvent receptacle 2. Thus, the user can attach the ends of a strap or similar devices to the plurality of strap-anchoring features 30 so that the present invention can be carried using the strap. In other embodiments, different mechanisms can be implemented to help the user transport the present invention in the storage configuration.

Although the invention has been explained in relation to its preferred embodiment, it is to be understood that many other possible modifications and variations can be made without departing from the spirit and scope of the invention.

What is claimed is:

1. A modular beverage container assembly comprising:

a drinking lid;

a solvent receptacle;

a dispensing cap;

a solute container;

a lid-interlocking snap feature;

a receptacle-interlocking snap feature;

a cap-interlocking snap feature;

a container-interlocking snap feature;

the solvent receptacle comprising an open receptacle end, a closed receptacle end, a receptacle lateral wall, and a plurality of receptacle partitions;

the solute container comprising an open container end, a closed container end, a container lateral wall, and a plurality of container partitions;

the lid-interlocking snap feature being integrated around the drinking lid;

the plurality of receptacle partitions being mounted within the receptacle lateral wall in between the open receptacle end and the closed receptacle end;

the receptacle-interlocking snap feature being integrated around the open receptacle end;

the cap-interlocking snap feature being integrated around the dispensing cap;

the plurality of container partitions being mounted within the container lateral wall in between the open container end and the closed container end;

the container-interlocking snap feature being integrated around the open container end; and the drinking lid, the solvent receptacle, the dispensing cap, and the solute container being operatively mounted to each other, wherein the drinking lid, the solvent receptacle, the dispensing cap, and the solute container are arranged between a storage configuration, a refill-solute configuration, a refill-solvent configuration, a drinking configuration, and a mixing configuration.

2. The modular beverage container assembly as claimed in claim 1 further comprising:

wherein the drinking lid, the solvent receptacle, the dispensing cap, and the solute container are arranged in the storage configuration;

a first twist-locking feature;

a second twist-locking feature;

the first twist-locking feature being integrated around the closed receptacle end;

the second twist-locking feature being integrated around the dispensing cap, offset from the cap-interlocking snap feature;

the lid-interlocking snap feature and the receptacle-interlocking snap feature being rotatably engaged to each other;

the first twist-locking feature and the second twist-locking feature being torsionally engaged to each other; and the cap-interlocking snap feature and the container-interlocking snap feature being rotatably engaged to each other.

3. The modular beverage container assembly as claimed in claim 2 further comprising:

the first twist-locking feature comprising a cylindrical recessed space and a plurality of hooks;

the second twist-locking feature comprising a cylindrical protrusion and a plurality of slots;

the cylindrical recessed space traversing into the closed receptacle end;

the plurality of hooks being peripherally connected to the closed receptacle end within the cylindrical recessed space;

the cylindrical protrusion being connected onto the dispensing cap, opposite to the cap-interlocking snap feature;

the plurality of slots being laterally integrated around the cylindrical protrusion; and each of the plurality of hooks being engaged into a corresponding slot of the plurality of slots.

4. The modular beverage container assembly as claimed in claim 1 further comprising:

wherein the drinking lid, the solvent receptacle, the dispensing cap, and the solute container are arranged in the refill-solute configuration; and the cap-interlocking snap feature and the container-interlocking snap feature being positioned offset from each other.

5. The modular beverage container assembly as claimed in claim 1 further comprising:

wherein the drinking lid, the solvent receptacle, the dispensing cap, and the solute container are arranged in the refill-solvent configuration; and the lid-interlocking snap feature and the receptacle-interlocking snap feature being positioned offset from each other.

6. The modular beverage container assembly as claimed in claim 1 further comprising:

wherein the drinking lid, the solvent receptacle, the dispensing cap, and the solute container are arranged in the drinking configuration;

a drinking spout;

the drinking spout being integrated through the drinking lid;

the drinking spout being peripherally positioned to the drinking lid;

the lid-interlocking snap feature and the receptacle-interlocking snap feature being operatively engaged to each other, wherein the lid-interlocking snap feature and the receptacle-interlocking snap feature are used to incrementally rotate the drinking lid in relation to the solute receptacle; and the drinking spout being in fluid communication with a selected receptacle partition from the plurality of receptacle partitions.

7. The modular beverage container assembly as claimed in claim 1 further comprising:

wherein the drinking lid, the solvent receptacle, the dispensing cap, and the solute container are arranged in the mixing configuration;

a dispensing channel;

the dispensing channel traversing through the dispensing cap;

the dispensing channel being peripherally positioned to the dispensing cap;

the cap-interlocking snap feature and the container-interlocking snap feature being operatively engaged to each other, wherein the cap-interlocking snap feature and the container-interlocking snap feature are used to incrementally rotate the dispensing cap in relation to the solvent container;

the dispensing channel being in fluid communication with a selected container partition from the plurality of container partitions; and the lid-interlocking snap feature and the receptacle-interlocking snap feature being positioned offset from each other.

8. The modular beverage container assembly as claimed in claim 1 further comprising:

the lid-interlocking snap feature comprising an annular lid recessed space;

the receptacle-interlocking snap feature comprising a plurality of receptacle spring-loaded spherical bearings;

the annular lid recessed space being laterally integrated into the drinking lid;

the plurality of receptacle spring-loaded spherical bearings being integrated around and into an inner annular surface of the open receptacle end; and each of the plurality of receptacle spring-loaded spherical bearings being engaged into the annular lid recessed space.

9. The modular beverage container assembly as claimed in claim 1 further comprising:

the cap-interlocking snap feature comprising an annular cap recessed space;

the container-interlocking snap feature comprising a plurality of container spring-loaded spherical bearings;

the annular cap recessed space being laterally integrated into the dispensing cap;

the plurality of container spring-loaded spherical bearings being integrated around and into an inner annular surface of the open container end; and each of the plurality of container spring-loaded spherical bearings being engaged into the annular cap recessed space.

10. The modular beverage container as claimed in claim 1 further comprising:

a plurality of strap-anchoring features;

the plurality of strap-anchoring features being distributed around the receptacle lateral wall; and the plurality of strap-anchoring features being laterally connected to the receptacle lateral wall.

11. A modular beverage container assembly comprising:

a drinking lid;

a solvent receptacle;

a dispensing cap;

a solute container;

a lid-interlocking snap feature;

a receptacle-interlocking snap feature;

a cap-interlocking snap feature;

a container-interlocking snap feature;

a plurality of strap-anchoring features;

the solvent receptacle comprising an open receptacle end, a closed receptacle end, a receptacle lateral wall, and a plurality of receptacle partitions;

the solute container comprising an open container end, a closed container end, a container lateral wall, and a plurality of container partitions;

the lid-interlocking snap feature being integrated around the drinking lid;

the plurality of receptacle partitions being mounted within the receptacle lateral wall in between the open receptacle end and the closed receptacle end;

the receptacle-interlocking snap feature being integrated around the open receptacle end;

the cap-interlocking snap feature being integrated around the dispensing cap;

the plurality of container partitions being mounted within the container lateral wall in between the open container end and the closed container end;

the container-interlocking snap feature being integrated around the open container end;

the plurality of strap-anchoring features being distributed around the receptacle lateral wall;

the plurality of strap-anchoring features being laterally connected to the receptacle lateral wall; and the drinking lid, the solvent receptacle, the dispensing cap, and the solute container being operatively mounted to each other, wherein the drinking lid, the solvent receptacle, the dispensing cap, and the solute container are arranged between a storage configuration, a refill-solute configuration, a refill-solvent configuration, a drinking configuration, and a mixing configuration.

12. The modular beverage container assembly as claimed in claim 11 further comprising:

wherein the drinking lid, the solvent receptacle, the dispensing cap, and the solute container are arranged in the storage configuration;

a first twist-locking feature;

a second twist-locking feature;

the first twist-locking feature being integrated around the closed receptacle end;

the second twist-locking feature being integrated around the dispensing cap, offset from the cap-interlocking snap feature;

the lid-interlocking snap feature and the receptacle-interlocking snap feature being rotatably engaged to each other;

the first twist-locking feature and the second twist-locking feature being torsionally engaged to each other; and the cap-interlocking snap feature and the container-interlocking snap feature being rotatably engaged to each other.

13. The modular beverage container assembly as claimed in claim 12 further comprising:

the first twist-locking feature comprising a cylindrical recessed space and a plurality of hooks;

the second twist-locking feature comprising a cylindrical protrusion and a plurality of slots;

the cylindrical recessed space traversing into the closed receptacle end;

the plurality of hooks being peripherally connected to the closed receptacle end within the cylindrical recessed space;

the cylindrical protrusion being connected onto the dispensing cap, opposite to the cap-interlocking snap feature;

the plurality of slots being laterally integrated around the cylindrical protrusion; and each of the plurality of hooks being engaged into a corresponding slot of the plurality of slots.

14. The modular beverage container assembly as claimed in claim 11 further comprising:

wherein the drinking lid, the solvent receptacle, the dispensing cap, and the solute container are arranged in the refill-solute configuration; and the cap-interlocking snap feature and the container-interlocking snap feature being positioned offset from each other.

15. The modular beverage container assembly as claimed in claim 11 further comprising:

wherein the drinking lid, the solvent receptacle, the dispensing cap, and the solute container are arranged in the refill-solvent configuration; and the lid-interlocking snap feature and the receptacle-interlocking snap feature being positioned offset from each other.

16. The modular beverage container assembly as claimed in claim 11 further comprising:

wherein the drinking lid, the solvent receptacle, the dispensing cap, and the solute container are arranged in the drinking configuration;

a drinking spout;

the drinking spout being integrated through the drinking lid;

the drinking spout being peripherally positioned to the drinking lid;

the lid-interlocking snap feature and the receptacle-interlocking snap feature being operatively engaged to each other, wherein the lid-interlocking snap feature and the receptacle-interlocking snap feature are used to incrementally rotate the drinking lid in relation to the solute receptacle; and the drinking spout being in fluid communication with a selected receptacle partition from the plurality of receptacle partitions.

17. The modular beverage container assembly as claimed in claim 11 further comprising:

wherein the drinking lid, the solvent receptacle, the dispensing cap, and the solute container are arranged in the mixing configuration;

a dispensing channel;

the dispensing channel traversing through the dispensing cap;

the dispensing channel being peripherally positioned to the dispensing cap;

the cap-interlocking snap feature and the container-interlocking snap feature being operatively engaged to each other, wherein the cap-interlocking snap feature and the container-interlocking snap feature are used to incrementally rotate the dispensing cap in relation to the solvent container;

the dispensing channel being in fluid communication with a selected container partition from the plurality of container partitions; and the lid-interlocking snap feature and the receptacle-interlocking snap feature being positioned offset from each other.

18. The modular beverage container assembly as claimed in claim 11 further comprising:

the lid-interlocking snap feature comprising an annular lid recessed space;

the receptacle-interlocking snap feature comprising a plurality of receptacle spring-loaded spherical bearings;

the annular lid recessed space being laterally integrated into the drinking lid;

the plurality of receptacle spring-loaded spherical bearings being integrated around and into an inner annular surface of the open receptacle end; and each of the plurality of receptacle spring-loaded spherical bearings being engaged into the annular lid recessed space.

19. The modular beverage container assembly as claimed in claim 11 further comprising:

the cap-interlocking snap feature comprising an annular cap recessed space;

the container-interlocking snap feature comprising a plurality of container spring-loaded spherical bearings;

the annular cap recessed space being laterally integrated into the dispensing cap;

the plurality of container spring-loaded spherical bearings being integrated around and into an inner annular surface of the open container end; and each of the plurality of container spring-loaded spherical bearings being engaged into the annular cap recessed space.

* * * * *